US005097911A

United States Patent [19]

Kendall

[11] Patent Number: 5,097,911

[45] Date of Patent: Mar. 24, 1992

[54] ROAD CLEARING MINE PLOW BLADE

[75] Inventor: Donald H. Kendall, Almont, Mass.

[73] Assignee: The United States of America as represented by the Secretary of the Army, Washington, D.C.

[21] Appl. No.: 722,817

[22] Filed: Jun. 28, 1991

[51] Int. Cl.[5] ..... E02F 3/76; F41H 11/12

[52] U.S. Cl. ..... 172/815; 172/701.1; 172/833; 89/1.13; 171/102

[58] Field of Search ..... 172/701.1, 701.3, 811, 172/815, 828, 833; 89/1.13; 171/102, 104, 105

[56] References Cited

U.S. PATENT DOCUMENTS

| | | | |
|---|---|---|---|
| 2,486,372 | 10/1949 | Rockwell | 89/1.13 |
| 2,763,944 | 9/1956 | Magee et al. | 172/701.1 |
| 3,424,251 | 1/1969 | Bouley | 172/815 |
| 4,024,922 | 5/1977 | Ronald | 172/701.1 |
| 4,077,142 | 3/1978 | Klett et al. | 172/701.3 |
| 4,467,694 | 8/1984 | Azulai et al. | 172/828 |
| 4,552,053 | 11/1985 | Bar-Nefy et al. | 89/1.13 |
| 4,690,030 | 9/1987 | Bar-Nefy et al. | 89/1.13 |
| 4,796,366 | 1/1989 | Scully | 172/815 |
| 4,919,034 | 4/1990 | Firth | 172/815 |
| 4,967,850 | 11/1990 | Bargfrede et al. | 89/1.13 |
| 4,991,662 | 2/1991 | Caron et al. | 172/701.1 |
| 5,046,565 | 9/1991 | Purcell | 172/239 |

FOREIGN PATENT DOCUMENTS

| | | | |
|---|---|---|---|
| 2112045 | 7/1983 | United Kingdom | 172/701.1 |

*Primary Examiner*—David H. Corbin
*Assistant Examiner*—Spencer Warnick
*Attorney, Agent, or Firm*—Peter A. Taucher; David L. Kuhn

[57] ABSTRACT

The invention is a generally V-shaped, rearwardly slanted plow blade having rearwardly tapering raking teeth disposed in a downwardly widening opening at a lower central portion of the blade.

14 Claims, 6 Drawing Sheets

ROAD CLEARING MINE PLOW BLADE

GOVERNMENT USE

The invention described herein may be manufactured, used and licensed by or for the U.S. Government for governmental purposes without payment to me of any royalty thereon.

BACKGROUND AND SUMMARY

One of the obstacles normally encountered by advancing ground troops is a series of mine fields. Historically, a number of techniques have been used to neutralize mines, such as detonating explosives ahead of an advancing column, pushing mine rollers ahead of tanks, or using flails to strike the ground in front of advancing vehicles. One other technique is to bulldoze or plow the ground by means of a blade mounted on the front of a vehicle. My invention is an improved blade for removing mines by this latter technique.

My invention is a combination bulldozer and plow blade that has teeth in the center to deeply rake earth through which they dig. The teeth allow loose earth to bypass them to an area underneath the tank, but the teeth cull out larger debris and mines. The cross sections of the teeth are rearwardly tapered to prevent an object from becoming wedged therebetween. A set of ridges disposed on the face of the blade carry the mines and larger debris from the teeth to the outboard edges of the blade for deposit in mounds beside the tank's path. The lower outboard zones of the blade dig earth in a bulldozing fashion and the ridges assist in the outboard movement of dug earth from these zones so that accumulation of earth in front of the blade is minimized and the power needed to continue plowing is reduced.

DETAILED DESCRIPTION

Figure 1:
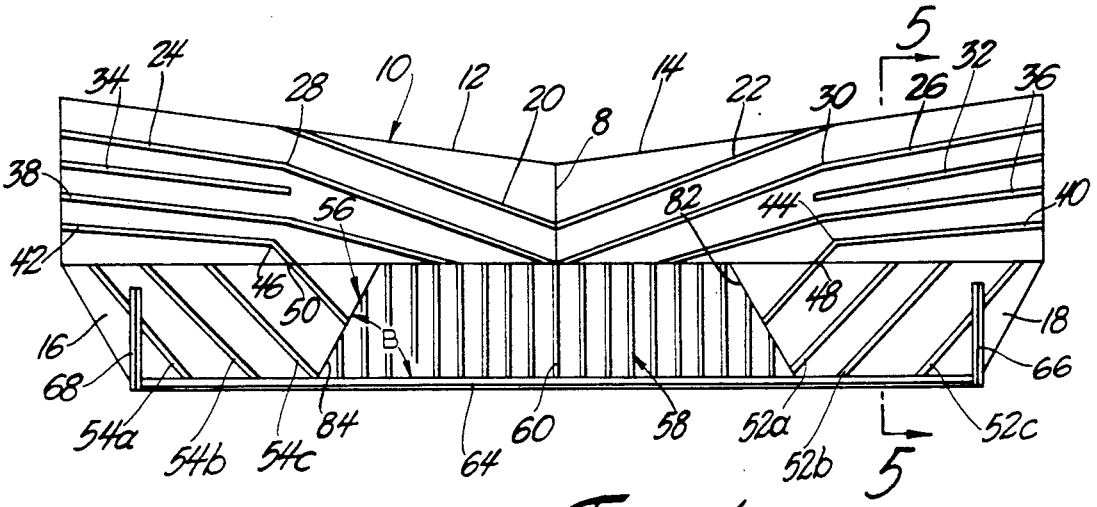
FIG. 1 is a front elevational view of my mine plow blade.
Figure 2:
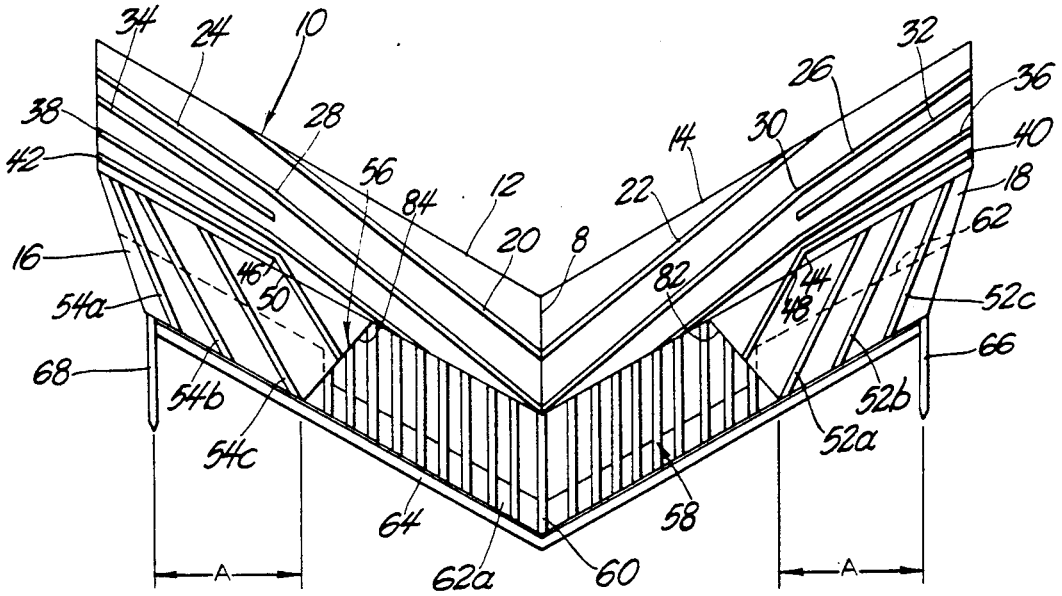
FIG. 2 is a top elevational view of my mine plow blade.

Shown in FIGS. 1 and 2 is mine plow blade 10 having two flat elongate symmetric upper plates 12 and 14 at the top of the blade, the upper plates being connected at prow line 8 at the center of the blade. Integral with the upper plates and forming oblique angles therewith are flat trapezoidal lower plates 16 and 18. The lower plates define two general planes, the longitudinal axis of each raking tooth 58 being parallel to one of the two general planes. It will be noted that all of the plates tilt rearward and that no part of the blade's front surface is either vertical or tilted forward. The rearward tilt of the blade inhibits loose earth falling forward from upper zones of the blade as the blade bulldozes, whereby the mass of earth pushed by the blade is minimized. It is possible for the blade to be curved or to be made as one integral plate, so long as the slope of any tangent to the blade is at a rearward tilt, whereby loosened dug earth does not fall forward from the face of the blade.

A symmetric system of ridges is disposed on blade 10, the ridges each having an inner end closer to the ground and an outer end higher or further from the ground. Upper ridges 20 and 22 meet at the center of the blade and are approximately parallel to longest ridges 24 and 26, which also meet at the center of the blade and which have slight dog leg bends at 28 and 30. Short straight ridges 32 and 34 between the longest ridges and dog leg ridges 36 and 38, and doubly bent ridges 40 and 42 are immediately below the dog leg ridges. Doubly bent ridges have obtuse bends at 44 and 46 and also are bent at 48 and 50 to follow the contour of blade 10 where upper and lower plates meet. At outboard zones of blade 10 on each of lower plates 16 and 18 are three short parallel ridges, ridges 52*a*, 52*b* and 52*c* being on lower plate 18 and ridges 54*a*, 54*b*, and 54*c* being on lower plate 16. The generally longitudinal spaces between any two ridges can be wider or narrower than that shown in the Figures, as desired.

Figure 7:
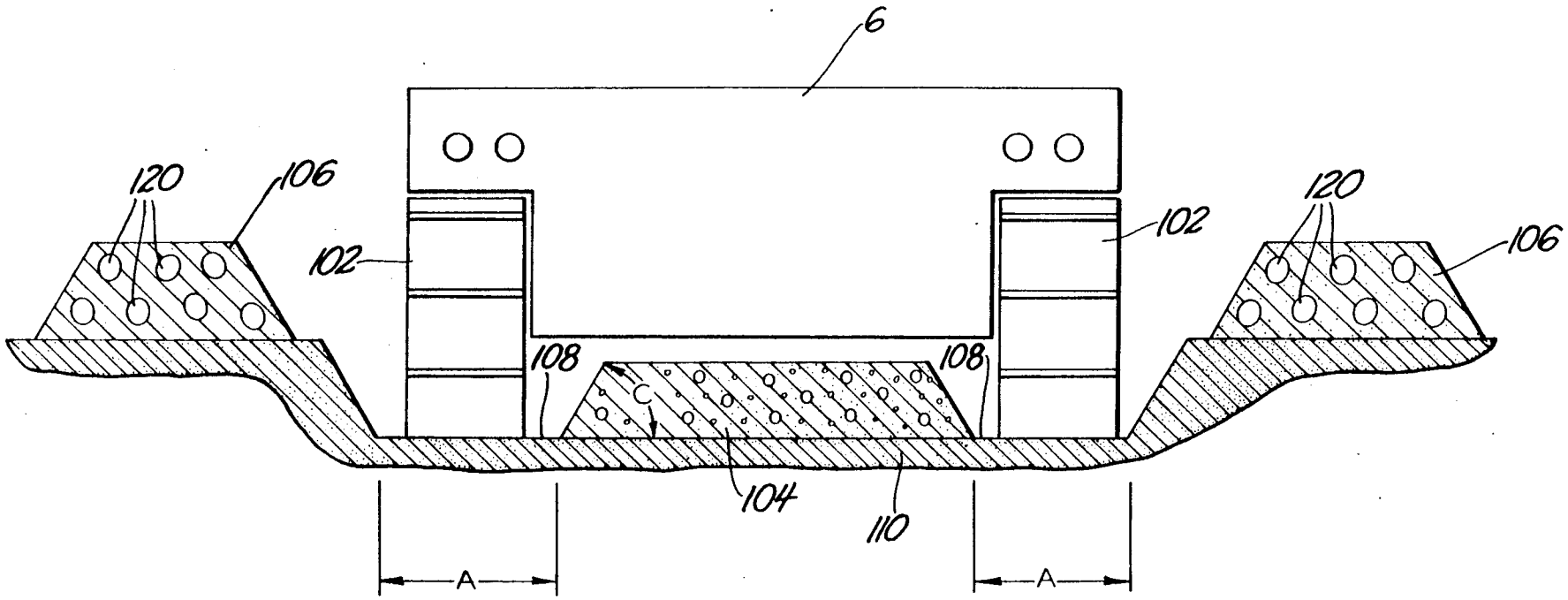
FIG. 7 is a rear elevational view of the tank as it passes over freshly plowed earth.

At the center of blade 10 below the upper plates is an opening 56 which narrows from bottom to top along sides 82 and 84. It is preferred that angle "B" between either of these sides and strip 64 be smaller than the angle of repose "C" between the side of mound 104 of loose dirt and the surface of compacted earth 110 (FIG. 7). Angle B's size keeps angle C within the mound's angle of repose, so the mound's loose dirt can not flow into trough 108 to impair traction of tracks 102. Opening 56 has mounted therein a plurality of raking teeth, as at 58, spaced so as to allow passage therebetween of dirt or small stones but not larger objects or land mines. A central raking tooth 60 is disposed along an extension of prow line 8.

Figure 5:
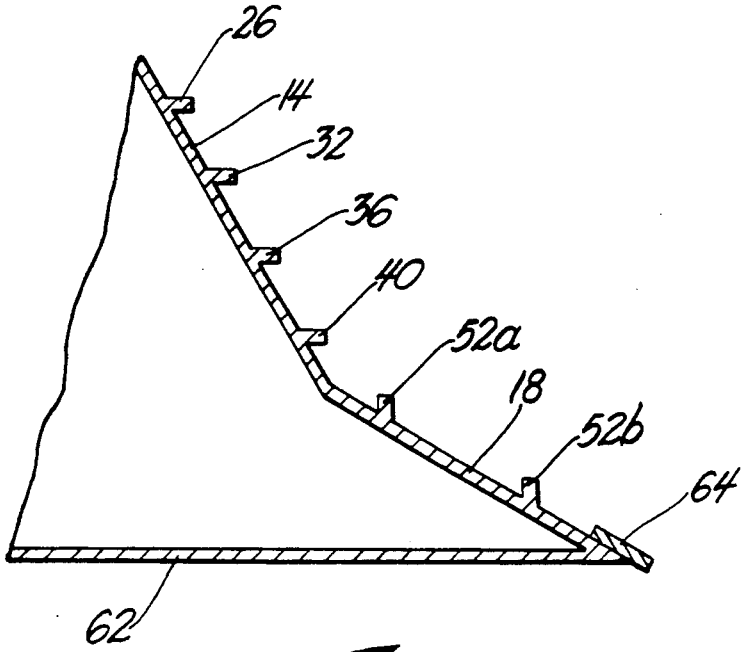
FIG. 5 is a sectional view taken along line 5—5 in FIG. 1.

A horizontal, generally V-shaped skid plate 62 connects the bottoms of the raking teeth and extends rearward from the lower, leading edge of blade 10. An intermediate zone 62*a* of the skid plate has a narrower fore-to-aft width than the more outboard zones of the skid plate and connects the bottoms of teeth 58 as seen by viewing FIGS. 2 and 3 together. The skid plate serves to brace the cutting teeth and to control the depth and cutting angle of blade 10. The skid plate keeps the blade from diving, or pivoting downward relative to the vehicle because of earth pressing against the front of the blade. On the front bottom of the blade is a replacable strip 64 that serves as a cutting edge across the entire width of the blade. As can be seen in FIG. 5, a portion of strip 64 projects below the plane in which skid plat 62 lies. As an option strip 64 can be sufficiently thick or sufficiently reinforced so that portion 62*a* (FIG. 3) of the skid plate can be eliminated. On either side of the blade are vertical edge cutters 66 and 68 which cut or break ground ahead of the blade.

Figure 3:
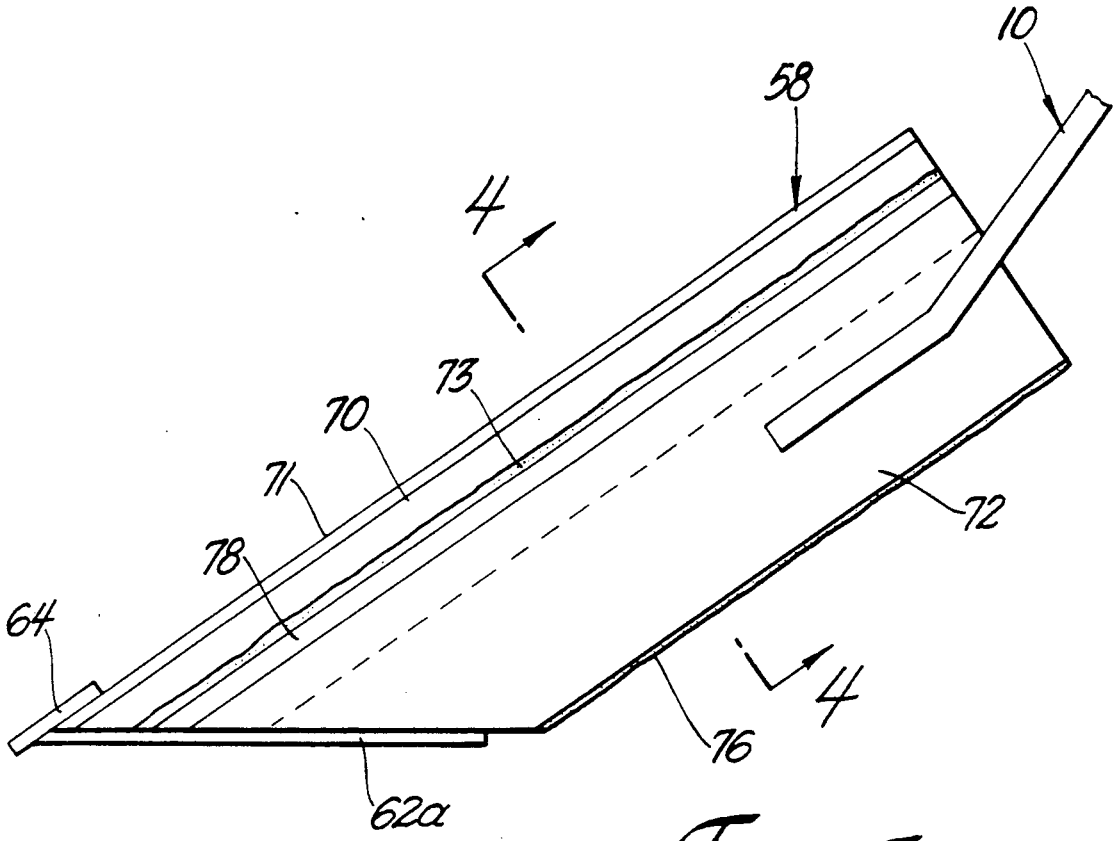
FIG. 3 is a detail view of one of the teeth of the mine plow blade.
Figure 4:
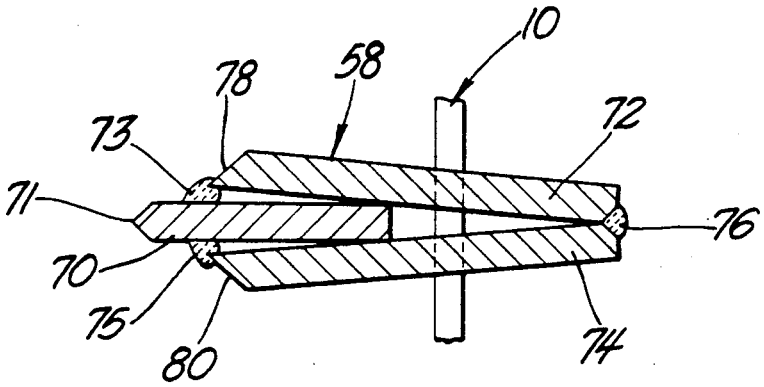
FIG. 4 is a section taken along line 4—4 in FIG. 3.

FIGS. 3 and 4 show details of one of teeth 58 welded or otherwise securely fixed to blade 10. At the front of the tooth is a sharp edged insert 70 for breaking or cutting ground, the insert being comprised of flat bar stock sharpened on the leading edge 71. Insert 70 is shown as welded at 73 and 75 to the tooth in the figures but it may preferred to bolt insert 70 to the tooth to facilitate removal and replacement of the insert. Insert 70 is held between two flats 72 and 74 which are fixed together at their rearward ends by a weld 76 and which have bevels 78 and 80 at their forward ends. As can best be seen from FIG. 4, tooth 58 is tapered in the rearward direction so that rocks and debris in loosened earth will not get wedged between teeth. It may be preferred in some applications that the angle between the bevels 78 and 80 be smaller than the angle between edge 71 and the general plane of skid plate 62. By this relative angular sizing, rocks or debris in soil pushing against blade have a tendency to travel upward along the teeth instead of jamming themselves between the teeth at the rear of the bevels.

Figure 8:
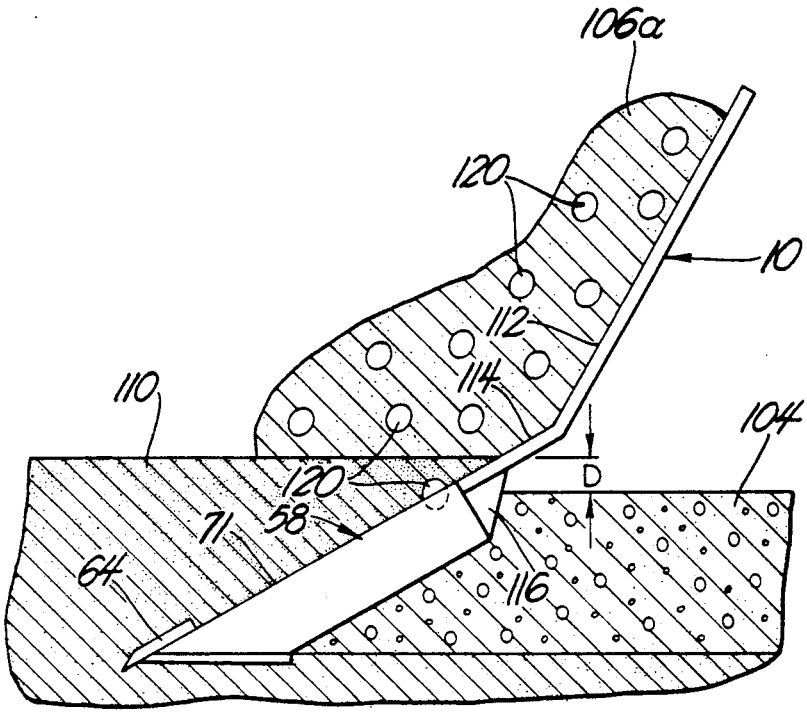
FIGS. 8 and 9 are cross-sectional views showing options for positions of teeth on the mine plow blade.

FIG. 8 shows a first optional placement of tooth 58 relative to the front face 112 of blade 10 wherein leading edge 71 of tooth 58 is flush with the front face. Right angle brace 116 is welded to blade 10 and tooth 58 to help secure the tooth to the blade. The portion 114 of the blade immediately above and behind the teeth will preferably protrude a depth "D" below the surface of earth 110 during mine plow operation, this depth typically being approximately two inches. This protruding of portion 114 causes an upward flow of loose dirt at the base of the blade, the flow tending to carry with it rocks, debris and mines, whereby the desired upward and outward movement of these items on the blade is enhanced.

Figure 9:
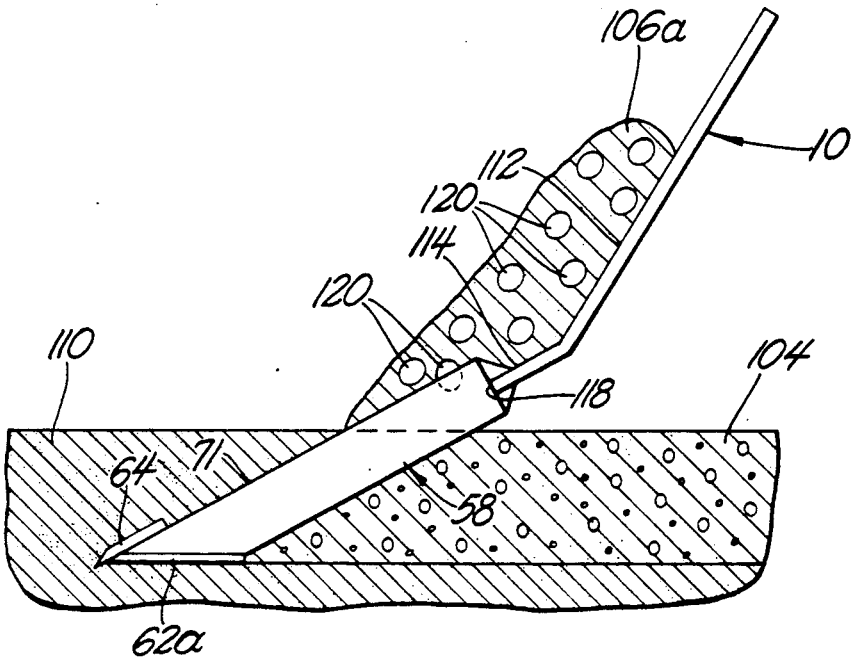

FIG. 9 shows a second optional placement of tooth 58 relative to the front face 112 of blade 10 wherein the leading edge 71 of tooth 58 is raised relative to the plane in which lies the forward surface of portion 114 at the base of blade 10. The advantage of this arrangement is its effect on a rock 120 or other item riding on leading edge 71 wherein the rock or other item is wider at its greatest girth than the gap between teeth 58. Rock 120 will tend to miss front edge 118 of portion 114 so as not to catch thereon and inhibit the flow of earth between teeth 58 or inhibit loosened material from flowing toward or upward upon the blade. Portion 114 of blade 10 need not protrude below the surface of earth 110 for the operation of the FIG. 9 arrangement.

Figure 10:
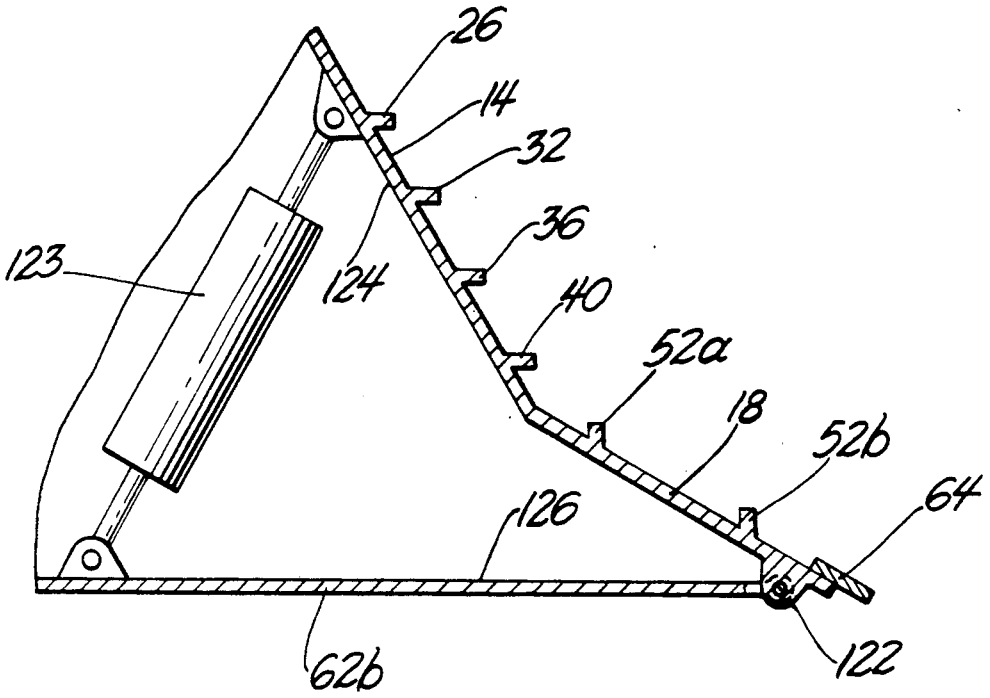
FIG. 10 is a cross-sectional view of the mine plow blade showing an alternate embodiment of the skid plate.

FIG. 10 shows still another optional feature of mine plow blade 10 wherein hinged skid plate sections **62*b* are the outboard edges of the blade. Sections 62*b* are preferably pivotable independently of each other about hinges 122. Double acting hydraulic cylinders 123 are pivotally connected between the rearward face 124 of blade 10 and the upper faces 126 of skid plate sections 62*b*. Pivoting sections 62*b* upward about hinge 122 during plowing permits mine plow blade to dive, or pivot downward relative to tank 6 (shown in FIG. 6), whereby the mine plow's position can adjust to an increase in downward slope encountered by tank 6. Pivoting sections 62*b* downward during plowing will cause blade 10 to pivot upward so as to adjust to an increase in upward incline encountered during mine plow operation. Pivoting only one of sections 62*b* about hinge 122 will cause one side of blade 10** to raise or lower, thereby tilting the blade. Obviously, pivoting the sections in opposite directions will cause a greater degree of tilt.

Figure 6:
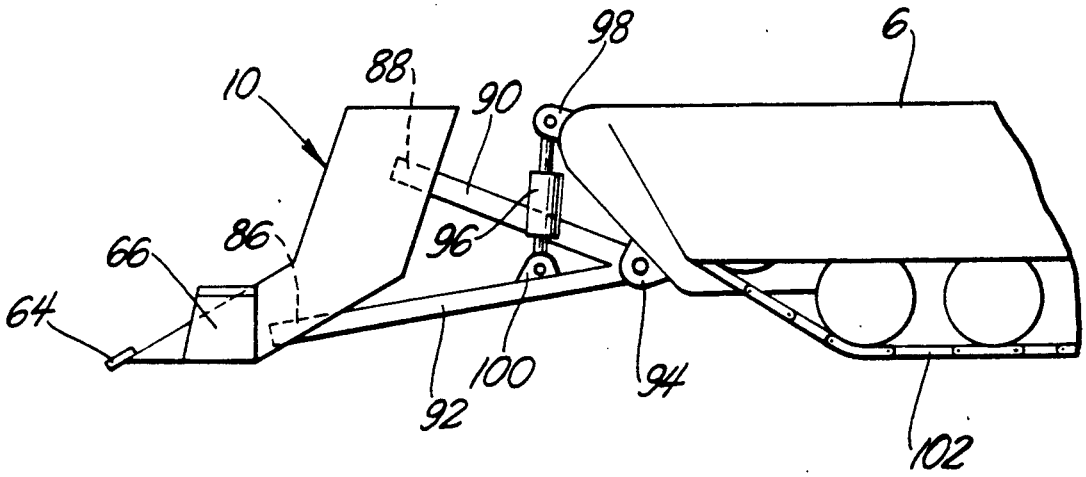
FIG. 6 is a side elevational view of the mine plow attached to the front of a tank.

FIG. 6 shows an example of how blade 10 can be attached to a tank 6 or like vehicle. An arm 90 is fixed at one end to blade 10 at 88 and is pivotally connected at the other end to hinge 94. A second arm 92 is likewise pivotally connected to hinge 94 and is rigidly connected to blade 10 at 86. A double acting hydraulic cylinder 96 is pivotally connected between bracket 98 on the exterior of tank 6 and bracket 100 mounted on arm 92, whereby actuation of the cylinder raises or lowers blade 10.

When tank 6 pushes blade 10 forward during operation, edge cutters 66 and 68 as well as strip 64 cut the earth. Earth in the center of the plow's path is raked by teeth 58, thereby leaving a mound of loose dirt 104 over which passes the body of tank 6, as illustrated in FIG. 7. An object dug up by teeth 58 too big to pass therebetween is guided upward by the teeth and then outward to debris mounds 106 by various ridges on the forward face of blade 10. It is preferred that the gaps between the ridges widen in the inboard-to-outboard direction so that rocks, mines and debris are less likely to be wedged between ridges as they travel outboard along the ridges. Also deposited in debris mounds 106 is earth outboard of the teeth, which is scraped onto lower plates 16 and 18 and then guided outboard by ridges at the outer edges of the blade. As a result of the blade's operation, two troughs 108 are formed which have a width "A" sufficient for tank tracks 102 to run on. At the bottoms of troughs 108 is earth 110 undisturbed by plow 10 and therefore relatively compacted and firm as compared to mounds 104 and 106. Mound 104 will be safe because mines or other dangerous objects will have been combed out of it. The passage of loose soil between teeth 58 minimizes the amount of material that must be moved aside by blade 10, thereby reducing stress on the blade and reducing the amount of fuel needed by tank 6 to mine sweep a given area.

I wish it to be understood that I do not desire to be limited to the exact details of construction shown and described herein since obvious modifications will occur to those skilled in the relevant arts without departing from the spirit and scope of the following claims.

I claim:

1. A blade for a mine clearing vehicle capable of moving a layer of earth over which the vehicle passes, the blade comprising:

two elongate flat upper plates joined together at a prow line of the blade to form a generally V-shaped configuration, the upper plates slanted rearward so that tops of the upper plates are nearer to the vehicle than bottoms of the upper plates;

a lower flat plate joined at a bottom outboard zone of each of the upper plates, the upper plates and the lower plates forming an obtuse angle therebetween, the lower plates each defining a general plane and are slanted more rearwardly than the upper plates;

a set of raking teeth disposed below the upper plates and between the lower plates, a longitudinal axis of each of the raking teeth being parallel to one of the two general planes defined by the lower plates, the set of raking teeth tapering rearwardly;

means for guiding dug material outboard on the blade, the guiding means including a set of ridges mounted on the upper and lower plates, the ridges having an inboard end and an outboard end, the inboard end being lower than the outboard end;

a skid plate fixed to the bottom of the blade and extended rearward from the blade, the skid plate parallel to and resting upon an exposed earth surface during an operational position of the blade, the skid plate fixed to and bracing the teeth;

a cutting strip removably attached to the front bottom zone of the blade adjacent the skid plate, the cutting strip having a portion projecting downwardly from the lower plates and having a portion connecting the teeth together;

edge cutters oriented in a vertical plane and disposed at outboard edges of the blade.

2. The blade of claim 1 wherein the teeth comprise:

a plate-like insert having a digging edge and a skid plate engagement edge at an acute angle with the digging edge;

support plates on either side of the insert and joined together at mating edges to form an acute angle therebetween, a portion of the insert digging edge protruding from between the support plates, edges of the support plates nearer to the digging edge having bevels tapered forwardly toward the digging edge.

3. The blade of claim 2 wherein an angle between the bevels is greater than an inclined angle between the digging edge of the insert and the skid plate.

4. The blade of claim 1 wherein the upper plates, the lower plates, and skid plate together enclose a region of the blade where the teeth are disposed, the region widening in the downward direction.

5. A blade for a mine clearing vehicle comprising:

two upper blade portions joined together at a prow line of the blade to form a generally V-shaped configuration, the upper plates slanting rearwardly whereby tops of the upper plates are nearer to the vehicle than bottoms of the upper plates;

a lower blade portion below each of the upper blade portions, the lower blade portions each defining a general plane and are slanted generally more rearwardly than the upper blade portions;

a set of raking teeth disposed below the upper blade portions and between the lower blade portions, the axis of each of the raking teeth parallel to one of the two general planes disposed along the lower blade portions;

means for guiding dug material outboard on the blade, the guiding means including a set of ridges mounted on the upper and lower blade portions, the ridges having an inboard end and an outboard end, the inboard end being lower than the outboard end.

6. The blade of claim 5 wherein the teeth comprise:

an insert having a digging edge and a skid plate engagement edge oblique to the digging edge;

support plates sandwiching the insert therebetween and joined together at mating edges to form an acute angle, a portion of the insert digging edge protruding from between the support plates, wherein edges of the support plates nearer to the digging edge portion have bevels tapered toward the digging edge portion.

7. The blade of claim 6 wherein the teeth taper from the support plate bevels toward the mating edges.

8. The blade of claim 5 wherein the upper blade portions, lower blade portions and skid plate together define an opening where the teeth are disposed such that sides of the opening slant in an outboard, downward direction.

9. The blade of claim 7 further comprising:

a skid plate fixed to the bottom of the blade extending rearwardly from the blade, the skid plate parallel to and resting upon an exposed earth surface during an operational position of the blade, the skid plate fixed to and bracing the teeth;

a cutting strip removably attached to a front bottom zone of the blade adjacent the skid plate, the cutting strip having a first strip portion projecting downwardly from the lower blade portions and having a second strip portion connecting the teeth together;

edge cutters oriented in a vertical plane and disposed at outboard edges of the blade.

10. The blade of claim 9 wherein the angle between the bevels is greater than an inclined angle between the digging edge of the insert and the skid plate.

11. The blade of claim 5 wherein the digging edges of the teeth protrude relative to the general planes of the lower blade portions.

12. The blade of claim 5 wherein the digging edges of the teeth are flush with forward surfaces at bottoms of the lower blade portions.

13. A blade for a mine clearing vehicle comprising:

two upper blade portions joined together at a prow line of the blade to form a generally V-shaped configuration, the upper blade portions slanting rearwardly whereby tops of the upper blade portions are nearer to the vehicle than bottoms of the upper blade portions;

a lower blade portion at a bottom outboard zone of each of the upper blade portions, the upper blade portions and the lower blade portions forming an obtuse angle therebetween, the lower blade portions each defining a general plane and are slanted more rearwardly than the upper blade portions;

a set of raking teeth disposed below the upper blade portions and between the lower blade portions, each of the raking teeth lying in one of two general planes disposed upon the lower blade portions;

means for guiding dug material outboard on the blade, the guiding means including a set of ridges mounted on the upper and lower blade portions, the ridges having an inboard end and an outboard end, the inboard end being lower than the outboard end;

one or more skid plates below the blade portions;

a hinge connecting each of the skid plates pivotally to the blade;

actuation means for pivoting the skid plates about the hinges and holding the skid plates in a selected position fixed relative to the blade.

14. The blade of claim 13 wherein one skid plate is connected to one lower blade portion and another skid plate is connected to another lower blade portion and the actuation means includes means to manipulate the skid plates independently of each other.

* * * * *